US009333622B2

(12) United States Patent
Barth et al.

(10) Patent No.: US 9,333,622 B2
(45) Date of Patent: May 10, 2016

(54) PROTECTIVE HOOD ROTATION PREVENTION DEVICE

(71) Applicant: Robert Bosch GmbH, Stuttgart (DE)

(72) Inventors: Daniel Barth, Leinfelden-Echterdingen (DE); Joachim Schadow, Stuttgart (DE); Sinisa Andrasic, Schoenaich (DE)

(73) Assignee: Robert Bosch GmbH, Stuttgart, DE (US)

( * ) Notice: Subject to any disclaimer, the term of this patent is extended or adjusted under 35 U.S.C. 154(b) by 8 days.

(21) Appl. No.: 14/368,106

(22) PCT Filed: Nov. 20, 2012

(86) PCT No.: PCT/EP2012/073018

§ 371 (c)(1),
(2) Date: Jun. 23, 2014

(87) PCT Pub. No.: WO2013/092056

PCT Pub. Date: Jun. 27, 2013

(65) Prior Publication Data

US 2014/0370793 A1 Dec. 18, 2014

(30) Foreign Application Priority Data

Dec. 23, 2011 (DE) ..... 10 2011 089 758

(51) Int. Cl.
*B24B 55/04* (2006.01)
*B24B 55/05* (2006.01)
*B24B 23/02* (2006.01)

(52) U.S. Cl.
CPC ..... *B24B 55/052* (2013.01); *B24B 23/02* (2013.01); *B24B 23/028* (2013.01); *B24B 55/05* (2013.01)

(58) Field of Classification Search
CPC ..... B24B 55/05; B24B 23/02; B24B 23/028
USPC ..... 451/359, 451, 455, 457
See application file for complete search history.

(56) References Cited

U.S. PATENT DOCUMENTS 4,924,635 A * 5/1990 Rudolf ..... B24B 55/052 451/344
5,005,321 A * 4/1991 Barth ..... B24B 55/052 451/359

(Continued)

FOREIGN PATENT DOCUMENTS

DE 10 2007 000 845 A1 4/2009
EP 1 618 990 A1 1/2006

(Continued)

OTHER PUBLICATIONS

International Search Report corresponding to PCT Application No. PCT/EP2012/073018, mailed Feb. 1, 2013 (German and English language document) (7 pages).

*Primary Examiner* — George Nguyen
(74) *Attorney, Agent, or Firm* — Maginot, Moore & Beck LLP

(57) ABSTRACT

A protective hood rotation prevention device for a power tool, in particular an angle grinder, includes a clamping unit that is configured to clamp a protective hood unit. The clamping unit includes at least one clamping element with a rotation prevention unit that has a rotation prevention element. The device further includes a movement coupling unit that is configured to move the rotation prevention element in at least one operating state depending on a movement of the clamping element. The device also includes a securing unit that is configured, in at least one operating state, to secure the rotation prevention element, in the event of a movement of the clamping element in a loosening direction of the clamping element, at least as far as possible counter to a movement in an uncoupling direction of the rotation prevention element out of a rotation prevention position of the rotation prevention element.

19 Claims, 3 Drawing Sheets

(56) References Cited

U.S. PATENT DOCUMENTS

| | | | | |
|---|---|---|---|---|
| 5,031,325 | A * | 7/1991 | Walter | B24B 55/052 125/13.01 |
| 6,893,334 | B1 * | 5/2005 | Stivers | B24B 55/052 451/354 |
| 7,909,680 | B2 * | 3/2011 | Boeck | B24B 23/02 451/344 |
| 7,927,191 | B2 * | 4/2011 | Esenwein | B24B 23/028 451/359 |
| 7,955,162 | B2 * | 6/2011 | Boeck | B24B 23/00 451/359 |
| 8,137,164 | B2 * | 3/2012 | Boeck | B24B 23/02 451/454 |
| 8,454,412 | B2 * | 6/2013 | Esenwein | B24B 55/052 451/344 |
| 8,523,640 | B2 * | 9/2013 | Esenwein | B24B 55/052 451/359 |
| 8,939,816 | B2 * | 1/2015 | Chen | B24B 23/028 451/359 |
| 9,085,063 | B2 * | 7/2015 | Esenwein | B24B 23/028 |
| 9,089,950 | B2 * | 7/2015 | Boeck | B24B 55/052 |
| 2008/0207098 | A1 * | 8/2008 | Andrasic | B24B 55/052 451/451 |
| 2008/0280549 | A1 * | 11/2008 | Sulea | B24B 23/02 451/451 |
| 2012/0052778 | A1 * | 3/2012 | Hiller | B24B 55/052 451/358 |

FOREIGN PATENT DOCUMENTS

| | | | |
|---|---|---|---|
| WO | 2008/058793 | A1 | 5/2008 |
| WO | 2008/058910 | A1 | 5/2008 |

* cited by examiner

PROTECTIVE HOOD ROTATION PREVENTION DEVICE

This application is a 35 U.S.C. §371 National Stage Application of PCT/EP2012/073018, filed on Nov. 20, 2012, which claims the benefit of priority to Serial No. DE 10 2011 089 758.5, filed on Dec. 23, 2011 in Germany, the disclosures of which are incorporated herein by reference in their entirety.

BACKGROUND

There is already known from WO 2008/058910 A1 a protective hood rotation prevention device of a power tool, in particular of an angle grinder, which has a clamping unit provided for clamping a protective hood unit and having a clamping element, a rotation prevention unit having a rotation prevention element, and which comprises a movement coupling unit, which is provided to move the rotation prevention element, in dependence on a movement of the clamping element, in an operating state.

SUMMARY

The disclosure is based on a protective hood rotation prevention device of a power tool, in particular of an angle grinder, having at least one clamping unit, which is provided for clamping a protective hood unit and which comprises at least one clamping element, having at least one a rotation prevention unit, which has at least one rotation prevention element, and having at least one movement coupling unit, which is provided to move the rotation prevention element, in dependence on a movement of the clamping element, in at least one operating state.

It is proposed that the protective hood rotation prevention device comprise at least one securing unit, which is provided, in the case of a movement of the clamping element in a loosening direction of the clamping element, to secure the rotation prevention element, at least to a very large extent, against a movement along a decoupling direction of the rotation prevention element, out of a rotation prevention position of the rotation prevention element, in at least one operating state. "Provided" is to be understood to mean, in particular, specially designed and/or specially equipped. The term "clamping unit" is intended there to define, in particular, a unit that, by means of a form closure and/or by means of a force closure, secures a protective hood unit to the power tool, in particular to a clamping collar of the power tool, for the purpose of protecting an operator while performing work on a workpiece. In this case, a clamping force, for clamping the protective hood unit, is preferably generated by means of a combined action of the clamping element and of a further clamping element of the clamping unit. The clamping element in this case may be realized as a clamping screw, as a clamping lever, as a bayonet closure element, etc. The further clamping element is preferably realized as a clamping band. The clamping band in this case is preferably fixed to the protective hood unit by means of a materially bonded type of connection such as, for example, by means of a welded connection, an adhesive connection, etc. It is also conceivable, however, for the further clamping element, realized as a clamping band, to be fixed to the protective hood unit by means of another type of connection considered appropriate by persons skilled in the art.

The expression "rotation prevention unit" is intended here to define, in particular, a unit that, by means of a form closed and/or force closed connection, prevents to a very large extent, in particular in addition to the clamping unit, a rotation of the protective hood unit, in a mounted state, relative to a clamping collar of the power tool in a case of damage to a working tool arranged on a tool receiver of the power tool. Particularly preferably, a form closed and/or force closed connection of the rotation prevention element is achieved by the rotation prevention element engaging in a rotation prevention recess arranged on the clamping collar of a tool receiver of the power tool. "A case of damage to a working tool" is to be understood here to mean, in particular, a rupture of the working tool when the power tool is in operation, wherein individual working tool parts are then flung outward, owing to a rotation of the working tool. Preferably, a position of the protective hood unit relative to the clamping collar of the power tool is retained to a very large extent by means of the rotation prevention element during the case of damage to the working tool.

The term "loosening direction" is intended here to define, in particular, a direction in which the clamping element is moved to remove a clamping force, for clamping the protective hood unit, that is generated by the combined action of the clamping element and of the further clamping element. The loosening direction in this case is preferably constituted by a direction of rotation of the clamping element about a longitudinal axis of the clamping element. The clamping element is preferably realized so as to be rotationally symmetrical in relation to the longitudinal axis. The expression "decoupling direction" is to be understood here to mean, in particular, a direction along which the rotation prevention element is moved for the purpose of removing a rotation prevention of the protective hood unit relative to the clamping collar of the power tool. In particular, a form closed and/or force closed connection between the rotation prevention element and a rotation prevention recess, arranged on the clamping collar of the power tool, is undone by a movement of the rotation prevention element along the decoupling direction. In this case, the rotation prevention element is preferably moved along the decoupling direction, out of the rotation prevention recess arranged on the clamping collar of the tool receiver of the power tool, in particular pivoted out. Preferably, the loosening direction of the clamping element is identical to the decoupling direction of the rotation prevention element. Particularly preferably, the rotation prevention element is secured, by means of the securing unit, in a position relative to the clamping element and/or relative to the further clamping element, in at least one operating state. By means of the design of the protective hood rotation prevention device according to the disclosure, it can be reliably ensured that a rotation prevention position of the rotation prevention element is maintained. Advantageously, as a result of an unintentional actuation of the clamping element and/or as a result of vibrations, caused by operation, that are generated during operation of the power tool, the rotation prevention position of the rotation prevention element can be maintained by means of the securing unit. Moreover, it is possible to achieve effective and, in particular, reliable protection of an operator of the power tool against the working tool rotating during operation of the power tool and/or in the case of damage to the working tool, such as, for example, in the case of rupture of the working tool, against parts of the working tool flying around in the direction of the operator. In addition, advantageously, owing to the dependence of the movement of the rotation prevention element on the clamping element, reliable movement of the rotation prevention element into a rotation prevention position can be achieved. Moreover, advantageously, an at least substantially automatic movement of the rotation prevention element by the movement dependence unit can be achieved, as a result of the protective hood unit being clamped to a clamping collar of the power tool.

Furthermore, it is proposed that the securing unit have at least one securing element, which is arranged on a further clamping element of the clamping unit that acts in combination with the clamping element. The securing element is preferably provided, in the case of a movement of the clamping element in a loosening direction of the clamping element, to secure the rotation prevention element, at least to a very large extent, against a movement along a decoupling direction of the rotation prevention element, out of rotation prevention position of the rotation prevention element, in at least one operating state, as the result of a form closed connection to the rotation prevention element. It is also conceivable, however, for the securing element to secure the rotation prevention element against a movement along the decoupling direction of the rotation prevention element, out of the rotation prevention position of the rotation prevention element, at least in an operating state, by means of a force closed connection. Advantageously, by means of the design of the protective hood rotation prevention device according to the disclosure, the rotation prevention element can be locked in the rotation prevention position, in at least one operating state.

It is additionally proposed that the securing element be realized so as to be integral with the further clamping element. "Integral with" is to be understood to mean, in particular, connected at least in a materially bonded manner, for example by a welding process, an adhesive process, an injection process and/or another process considered appropriate by persons skilled in the art, and/or, advantageously, formed in one piece such as, for example, by being produced from a casting and/or by being produced in a single or multi-component injection process and, advantageously, from a single blank. It is also conceivable, however, for the securing element to be constituted by a component that is separate from the further clamping element, and that is fixed to the further clamping element by means of a fastening technique considered appropriate by persons skilled in the art. By means of the design according to the disclosure, it is advantageously possible to achieve a compact arrangement of the securing element. In addition, advantageously, savings in structural space, costs and assembly work can be achieved.

Advantageously, the securing unit has at least one decoupling element, which is provided to decouple a movement of the rotation prevention element, when the rotation prevention element is in a decoupling position, at least along the decoupling direction of the rotation prevention element, from a movement of the clamping element along the loosening direction of the clamping element, in at least one operating state. Preferably, upon an actuation of the clamping element, the clamping element is moved relative to the rotation prevention element as the result of a form closed connection of the rotation prevention element to the decoupling element along the decoupling direction, when the rotation prevention element is in the decoupling position. Advantageously, it is possible to achieve a movement of the clamping element, along the loosening direction, that is independent of a movement of the rotation prevention element, when the rotation prevention element is in the decoupling position, for the purpose of removing a clamping force provided for clamping the protective hood unit. In addition, advantageously, it is possible to achieve a limitation of the movement of the rotation prevention element along a movement distance of the rotation prevention element, in particular along a movement distance from the rotation prevention position to the decoupling position. It can thereby be ensured, in particular, that, in the case of a movement of the clamping element into the releasing position, the rotation prevention element moves maximally as far as the unlocking position of the rotation prevention element.

Particularly preferably, the decoupling element is arranged on a further clamping element of the clamping unit that acts in combination with the clamping element. Particularly preferably, the decoupling element is realized so as to be integral with the further clamping element. In this case, the decoupling element is preferably integrally formed on to a clamping element end of the further clamping element that runs at least substantially perpendicularly in relation to a protective hood collar. It is also conceivable, however, for the decoupling element to be arranged at another position considered appropriate by persons skilled in the art. Advantageously, a compact securing unit can be achieved.

Furthermore, it is proposed that the rotation prevention element have at least one stop surface, which acts in combination at least with a securing element of the securing unit, in at least one operating state. Thus, advantageously, a form closed connection can be used to secure the rotation prevention element in the rotation prevention position of the rotation prevention element. As a result, an inexpensive securing unit can be achieved.

Advantageously, the rotation prevention element is coupled to the clamping element by form closure and/or force closure. Particularly preferably, the rotation prevention element is coupled to the clamping element by force closure by means of a spot coating of the clamping element or by means of a thread of the rotation prevention element. In this case, the thread preferably has at least one pitch that differs from a thread of the clamping element, in order to realize a thread that is stiff in at least one direction. It is also conceivable, however, for the rotation prevention element to be coupled to the clamping element by form closure and/or force closure by means of other possibilities, considered appropriate by persons skilled in the art, for realizing the movement coupling unit. Advantageously, an inexpensive movement coupling unit can be achieved.

It is additionally proposed that the rotation prevention element be mounted so as to be movable relative to a further clamping element, in at least one operating state. In this case, the rotation prevention element is mounted so as to be pivotable relative to the further clamping element, in at least one operating state. Preferably, the movement coupling unit is provided to pivot the rotation prevention element into a rotation prevention position, as a result of a rotary movement of the clamping element, in at least one operating state. A movement of the rotation prevention element into the rotation prevention position can be achieved through simple design means. In this case, the rotation prevention element, in the rotation prevention position, preferably engages in at least one rotation prevention recess arranged on the clamping collar of the tool receiver.

Advantageously, the rotation prevention element has at least one pivot axis, which runs at least substantially parallelwise in relation to a longitudinal axis of the clamping element. "Substantially parallelwise" is intended here to mean, in particular, an alignment of a direction relative to a reference direction, in particular in one plane, wherein the direction deviates from the reference direction by, in particular, less than 8°, advantageously less than 5°, and particularly advantageously less than 2°. Advantageously, it is possible to achieve a compact arrangement, in particular an arrangement of the rotation prevention element on the clamping element.

The disclosure is additionally based on a power tool system, having at least the protective hood rotation prevention device according to the disclosure, having at least one power tool, in particular an angle grinder, and having at least one protective hood unit. The power tool is preferably realized as a portable power tool, in particular as a portable, hand-held power tool. A "portable power tool" is to be understood here to mean, in particular, a power tool for performing work on workpieces, that can be transported by an operator without the use of a transport machine. The portable power tool has, in particular, a mass of less than 40 kg, preferably less than 10 kg, and particularly preferably less than 7 kg. Advantageously, by means of the design according to the disclosure, a high degree of safety can be achieved for an operator when working with the power tool.

The protective hood rotation prevention device according to the disclosure and/or the power tool system according to the disclosure are/is not intended in this case to be limited to the application and embodiment described above. In particular, the protective hood rotation prevention device according to the disclosure and/or the power tool system according to the disclosure may have individual elements, components and units that differ in number from a number stated herein, in order to fulfill a principle of function described herein.

BRIEF DESCRIPTION OF THE DRAWINGS

Further advantages are given by the following description of the drawings. The drawings show an exemplary embodiment of the disclosure. The drawings, the description and the claims contain numerous features in combination. Persons skilled in the art will also expediently consider the features individually and combine them to create appropriate further combinations.

In the drawings.

DETAILED DESCRIPTION

Figure 1:
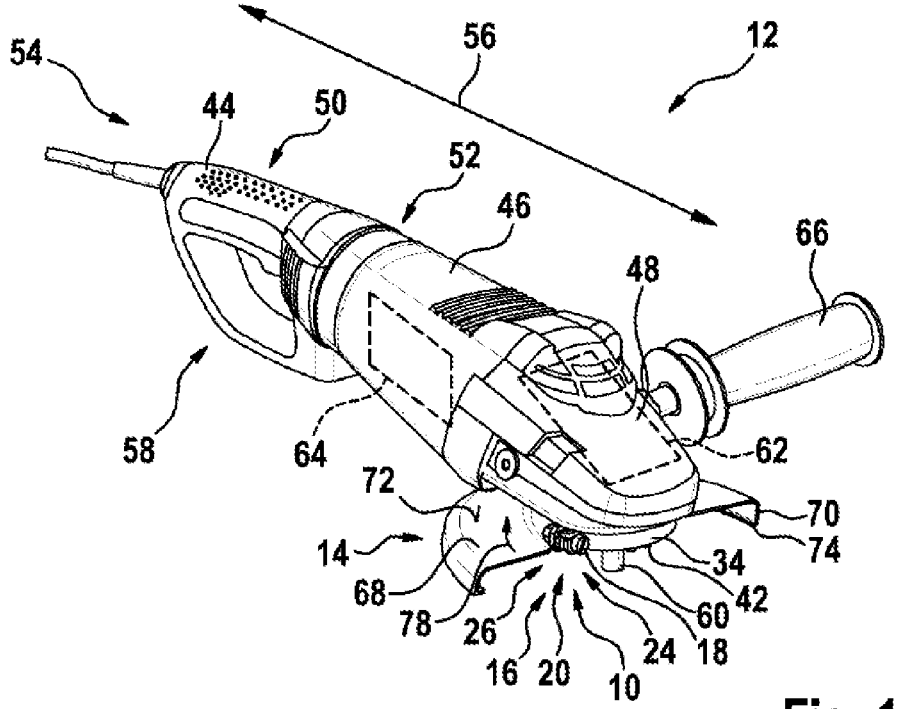
FIG. 1 shows a power tool system according to the disclosure, in a schematic representation.

FIG. 1 shows a power tool system, which comprises a power tool 12, which is constituted by a portable power tool realized as an angle grinder, a protective hood unit 14, and a protective hood rotation prevention device 10. The protective hood rotation prevention device 10 of the power tool system comprises at least one clamping unit 16, which is provided for clamping the protective hood unit 14 and which comprises at least one clamping element 18, at least one a rotation prevention unit 20, which has at least one rotation prevention element 22, and at least one movement coupling unit 24, which is provided to move the rotation prevention element 22, in dependence on a movement of the clamping element 18, in at least one operating state. The clamping unit 16 additionally has at least one further clamping element 34. The rotation prevention element 22 in this case is realized separately from the clamping element 18 and separately from the further clamping element 34. The protective hood unit 14, when arranged on the power tool 12, is clamped in at least one position on a clamping collar 98 of the tool receiver 42 of the power tool 12, by means of a form closed and/or force closed connection, by means of a combined action of the clamping element 18 and of the further clamping element 34, in a manner already known to persons skilled in the art.

The power tool 12, realized as an angle grinder, additionally comprises a handle housing 44, a drive housing 46 and an output housing 48. A stem-type grip region 50 of the handle housing 44 in this case constitutes a main handle of the power tool 12. The main handle extends, at least substantially, starting from a connecting region 52 of the handle housing 44, in a direction away from the connecting region 52, as far as a side 54 of the handle housing 44 on which there is arranged a cable of the power tool 12, realized as an angle grinder, for supplying energy. The stem-type grip region 50 of the handle housing 44 is offset relative to a direction of main extent 56 of the power tool 12, by an angle of less than 30°. Moreover, the handle housing 44, in addition to having the stem-type grip region 50, has a bow-shaped sub-region 58, which is integrally formed on to the stem-type grip region 50. The bow-shaped sub-region 58 is of an L-shaped design, which extends in an L shape in the direction of the connecting region 52, out from an end of the stem-type grip region 50 that faces away from the connecting region 52 of the handle housing 44. Extending out from the output housing 48 there is an output shaft 60 of an output unit 62 of the power tool 12, which is realized as a spindle, to which a working tool (not represented in greater detail here) can be fixed, for performing work on a workpiece (not represented in greater detail here). The working tool may be realized as an abrasive disk, as a parting disk or as a polishing disk. The power tool 12 comprises the drive housing 46, for accommodating a drive unit 64 of the power tool 12, and the output housing 48, for accommodating the output unit 62. The drive unit 64 is provided to drive the working tool in rotation, via the output unit 62. For the purpose of performing work on a workpiece, the working tool in this case may be connected to the output shaft 60 in a rotationally fixed manner by means of a fastening element (not represented in greater detail here). The working tool can thus be driven in rotation when the power tool 12 is in operation. The output unit 62 is connected to the drive unit 64 via a drive element (not represented in greater detail here) of the drive unit 64 that is realized as a pinion gear and that can be driven in rotation, in a manner already known to persons skilled in the art. In addition, an ancillary handle 66 is arranged on the output housing 48. When mounted on the output housing 48, the ancillary handle 66 extends transversely in relation to the direction of main extent 56 of the power tool 12.

Figure 2:
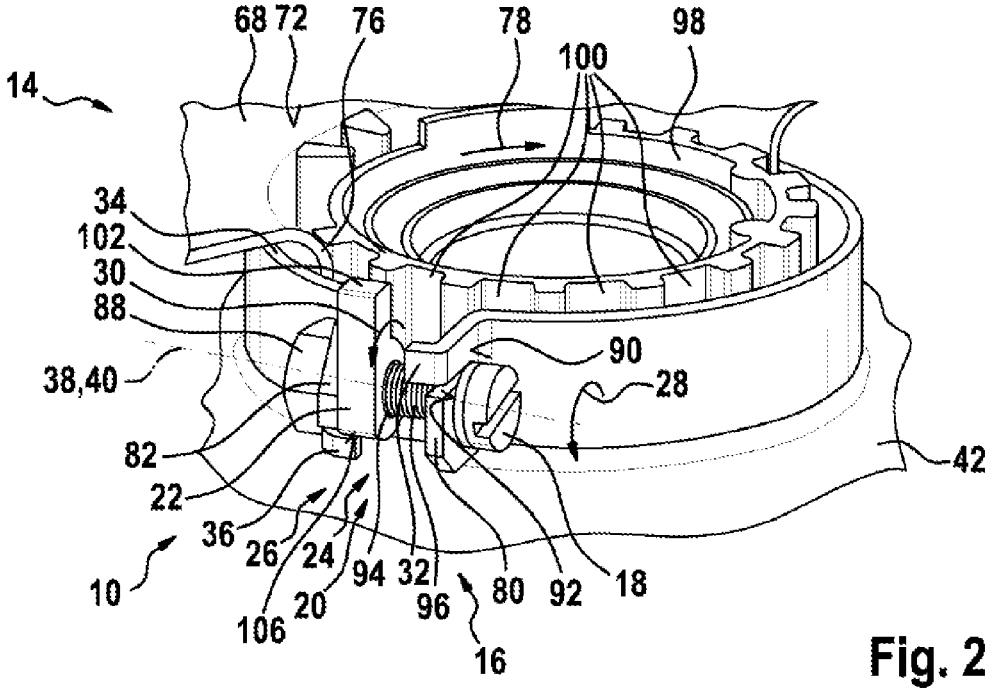
FIG. 2 shows a detail view of a decoupling position of a rotation prevention element of a rotation prevention unit of a protective hood rotation prevention device according to the disclosure of the power tool system according to the disclosure, in a schematic representation.

FIG. 2 shows a detail view of the protective hood unit 14, on which the protective hood rotation prevention device 10 is arranged, when arranged on a clamping collar 98 of the tool receiver 42 of the power tool 12. The protective hood unit 14 has a semicircular protective hood cover region 68, which, when fixed to the clamping collar 98 of the tool receiver 42, covers a working tool that is coupled to the output shaft 60, along an angular range of approximately 180°. When the protective hood unit 14 has been fixed to the clamping collar 98 of the tool receiver 42, the protective hood cover region 68 extends in a plane that runs at least substantially perpendicularly in relation to a rotation axis of the output shaft 60. Furthermore, the protective hood unit 14 has at least one protective hood side wall 70, which is arranged at least substantially transversely in relation to a surface of main extent 72 of the protective hood cover region 68 and, when fixed to the clamping collar 98 of the tool receiver 42, radially surrounds a working tool that is coupled to the output shaft 60, along an angular range of approximately 180°. In addition, the protective hood unit 14 has a protective hood flange 74, which is arranged, transversely in relation to the protective hood side wall 70, on a side of the protective hood side wall 70 that faces away from the protective hood cover region 68, at least substantially parallelwise protective hood cover region 68. In this case, the protective hood flange 74, as viewed in a state in which the protective hood unit 14 has been fixed to the clamping collar 98 of the tool receiver 42, extends radially inward, out from the protective hood side wall 70, in the direction of the output shaft 60. In addition, the protective hood unit 14 comprises a protective hood collar 76, which is arranged on the protective hood cover region 68. The protective hood collar 76 extends at least substantially perpendicularly in relation to the surface of main extent 72 of the protective hood cover region 68, and at least substantially parallelwise in relation to the protective hood side wall 70. The further clamping element 34 in this case is fixed to the protective hood collar 76 by form closure, force closure and/or material bonding. The further clamping element 34 is realized as a clamping band, which is fixed to an outer contour of the protective hood collar 76. In addition, the protective hood unit 14 has an axial securing extension (not represented in greater detail here), which is integrally formed on to the protective hood collar 76. The axial securing extension extends out from the protective hood collar 76, as viewed when the protective hood unit 14 has been fixed to the clamping collar 98 of the tool receiver 42, in the direction of the output shaft 60. In this case, the axial securing extension is provided to act in combination with a corresponding axial securing groove (not represented in greater detail here) of the clamping collar 98, in a manner already known to persons skilled in the art, when the protective hood unit 14 has been fixed to the clamping collar 98 of the tool receiver 42.

Figure 3:
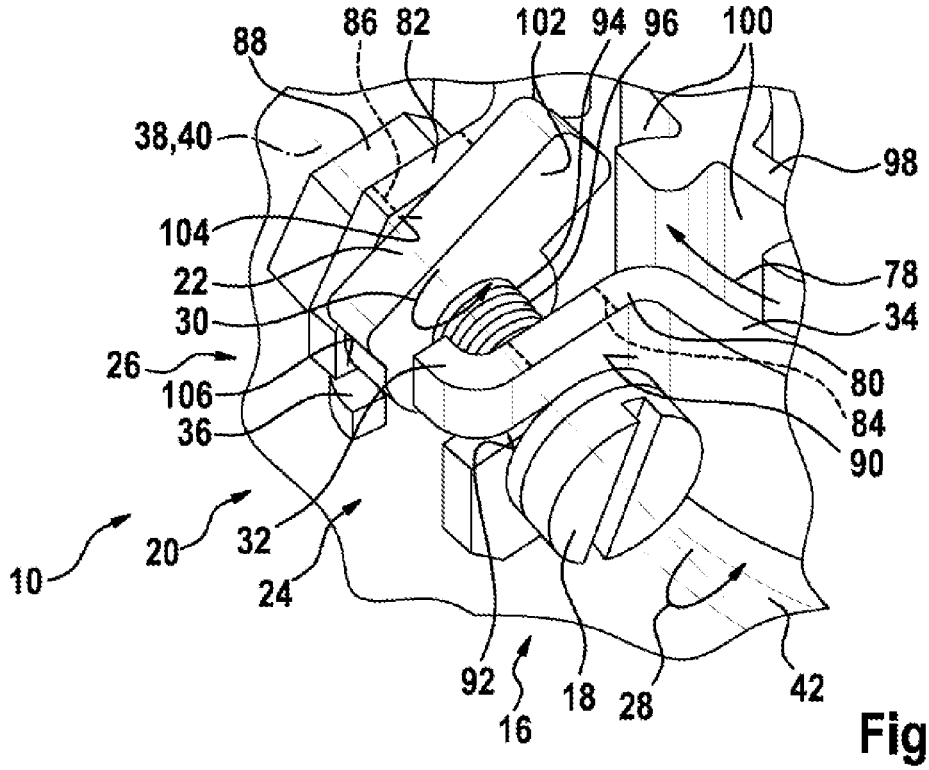
FIG. 3 shows a detail view of the protective hood rotation prevention device according to the disclosure during a conversion of the rotation prevention element to a rotation prevention position, in a schematic representation.

The further clamping element 34, realized as a clamping band, has a basic region that is at least substantially in the shape of a circular ring. In this case, the basic region of the further clamping element 34, realized as a clamping band, has a maximum total circumferential extent that, in at least one operating state, extends along an angular region that is less than 360°. In this case, the total circumferential extent of the basic region of the further clamping element 34 runs along a circumferential direction 78 that, when the protective hood unit 14 has been mounted on the power tool 12, runs in a plane extending at least substantially perpendicularly in relation to the rotation axis of the output shaft 60. The further clamping element 34 has a clamping element end 80 that, at least in an operating state, as viewed along the circumferential direction 78, is arranged at a distance apart from a further clamping element end 82 of the further clamping element 34. The clamping element end 80 and the further clamping element end 82 extend, starting from the basic region of the clamping element 34, at least substantially transversely in relation to the circumferential direction 78. In this case, the clamping element end 80 and the further clamping element end 82 are integrally formed on to the basic region of the further clamping element 34 that is in the shape of a circular ring. In addition, the clamping element end 80 and the further clamping element end 82 each respectively have one of at least two receiving recesses 84, 86 of the further clamping element 34, in which the clamping element 18 can be arranged, at least partially (FIG. 3). The clamping element 18 in this case is realized as a clamping screw, which, when arranged on the further clamping element 34, extends through the receiving recesses 84, 86. The clamping element 18 in this case acts in combination with a counter-clamping element 88 of the clamping unit 16 that is realized so as to correspond with the clamping element 18*a*. The counter-clamping element 88 is realized as a clamping nut, which has a thread that corresponds with a thread of the of the clamping element 18 that is realized as a clamping screw. The counter-clamping element 88 is arranged on the further clamping element end 82, on a side of the further clamping element end 82 that faces away from the clamping element end 80, by means of a form closed, force closed and/or materially bonded connection. Thus, by means of screwing the clamping element 18, realized as a clamping screw, into the counter-clamping element 88, realized as a clamping nut, in a manner already known to persons skilled in the art, it is possible to achieve a movement of the clamping element end 80 and of the further clamping element end 82 relative to each other, for the purpose of clamping the protective hood unit 14 to the clamping collar 98 of the tool receiver 42. The clamping unit 16 thus comprises at least one screw unit for clamping the protective hood unit 14. It is also conceivable, however, for the clamping unit 16 to have a different unit, considered appropriate by persons skilled in the art, for clamping the protective hood unit 14, such as, for example, a lever unit, a bayonet closure unit, etc.

The rotation prevention element 22 is coupled to the clamping element 18 by form closure and/or force closure. In this case, the rotation prevention element 22 has an internal thread 94 that, in at least one operating state, acts in combination with an external thread 96 of the clamping element 18 for the purpose of moving the rotation prevention element 22 in dependence on a movement of the clamping element 18. The rotation prevention element 22 is mounted so as to be movable relative to the further clamping element 34, in at least one operating state. In this case, the rotation prevention element 22 is mounted so as to be pivotable relative to the further clamping element 34, in at least one operating state. The rotation prevention element 22 has at least one pivot axis 38, which runs at least substantially parallelwise in relation to a longitudinal axis 40 of the clamping element 18. The pivot axis 38 is realized so as to be identical to the longitudinal axis 40 of the clamping element 18. The rotation prevention element 22 can thus be pivoted, or rotated, abut the pivot axis 38, together with the clamping element 18, in at least one operating state.

The protective hood rotation prevention device 10 additionally has at least one securing unit 26, which is provided, in the case of a movement of the clamping element 18 in a loosening direction 28 of the clamping element 18, to secure the rotation prevention element 22, at least to a very large extent, against a movement along a decoupling direction 30 of the rotation prevention element 22, out of a rotation prevention position of the rotation prevention element 22, in at least one operating state. The securing unit 26 has at least one securing element 32, which is arranged on the further clamping element 34 of the clamping unit 16 that acts in combination with the clamping element 18. The securing element 32 is realized so as to be integral with the further clamping element 34. In this case, the securing element 32 is constituted by an extension of the clamping element end 80 that extends at least substantially perpendicularly in relation to a clamping surface 90 of the clamping element end 80. The securing element 32, starting from the clamping element end 80, extends in the direction of the further clamping element end 82. The clamping surface 90 in this case acts in combination with a clamping surface 92 of the clamping element 18 that is realized as a clamping screw, for the purpose of clamping the protective hood unit 14.

The securing unit 26 additionally has at least one decoupling element 36, which is provided to decouple a movement of the rotation prevention element 22, when the rotation prevention element 22 is in a decoupling position, at least along the decoupling direction 30 of the rotation prevention element 22, from a movement of the clamping element 18 along the loosening direction 28 of the clamping element 18, in at least one operating state. The decoupling element 36 is arranged on the further clamping element 34 of the clamping unit 16 that acts in combination with the clamping element 18. In this case, the decoupling element 36 is realized so as to be integral with the further clamping element 34. The securing element 32 is constituted by an extension of the further clamping element end 82 that extends at least substantially perpendicularly in relation to a lateral surface 104 of the further clamping element end 82. The lateral surface 104 is arranged on a side of the further clamping element end 82 that faces toward the clamping element end 80 of the further clamping element 34 (FIG. 3). The decoupling element 36 extends out from the further clamping element end 82, in the direction of the clamping element end 80.

Figure 5:
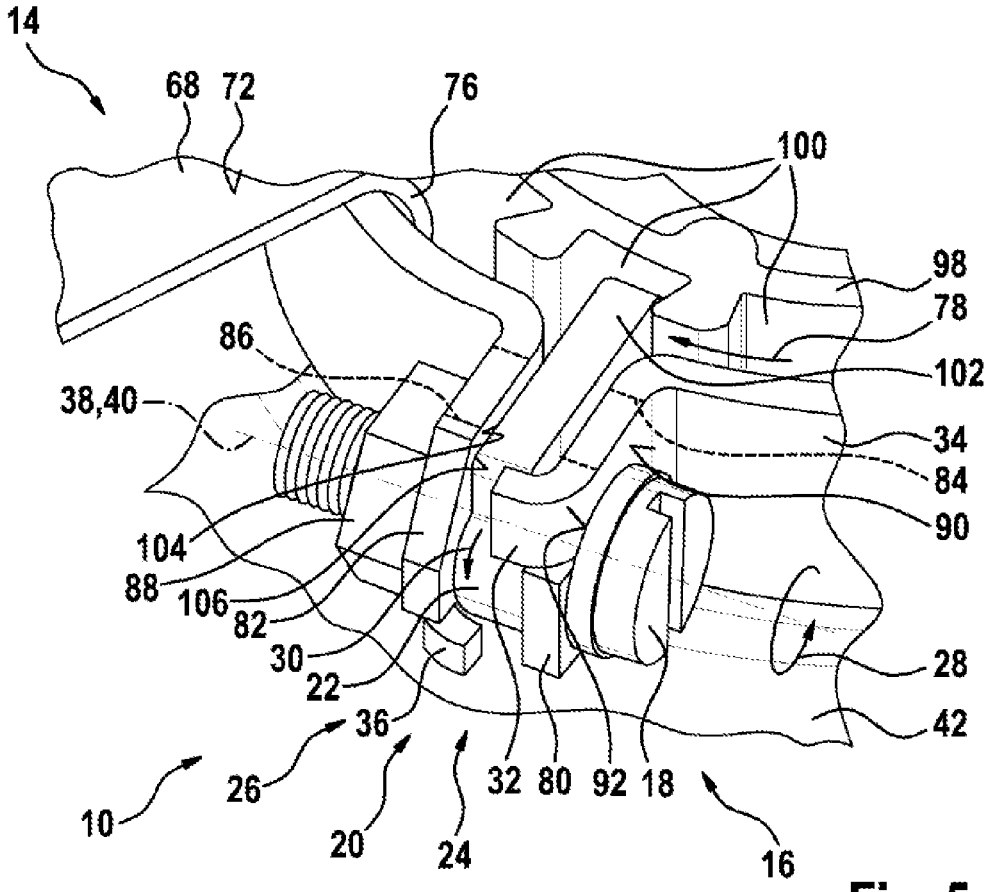
FIG. 5 shows a detail view of the rotation prevention element in a secured rotation prevention position, in a schematic representation.

The rotation prevention element 22 has at least one stop surface 106, which at least acts in combination with the decoupling element 36 of the securing unit 26, in at least one operating state. In this case, when in the rotation prevention element 22 is in the decoupling position, the stop surface 106 bears against the stop surface 106. As a result of this, in the case of a movement of the clamping element 18 in the loosening direction 28, about the longitudinal axis 40 of the clamping element 18, relative to the further clamping element 34, a movement of the rotation prevention element 22 along the loosening direction 28 is prevented, at least to a very large extent. The rotation prevention element 22 additionally has at least the stop surface 106, which at least acts in combination with the securing element 32 of the securing unit 26, in at least one operating state (FIG. 5). In this case, the stop surface 106 acts in combination when the rotation prevention element 22 is in a secured rotation prevention position. The rotation prevention element 22, as viewed along the longitudinal axis 40 of the clamping element 18, is arranged spatially between the clamping element end 80 and the clamping element end 82 of the further clamping element 34.

Figure 4:
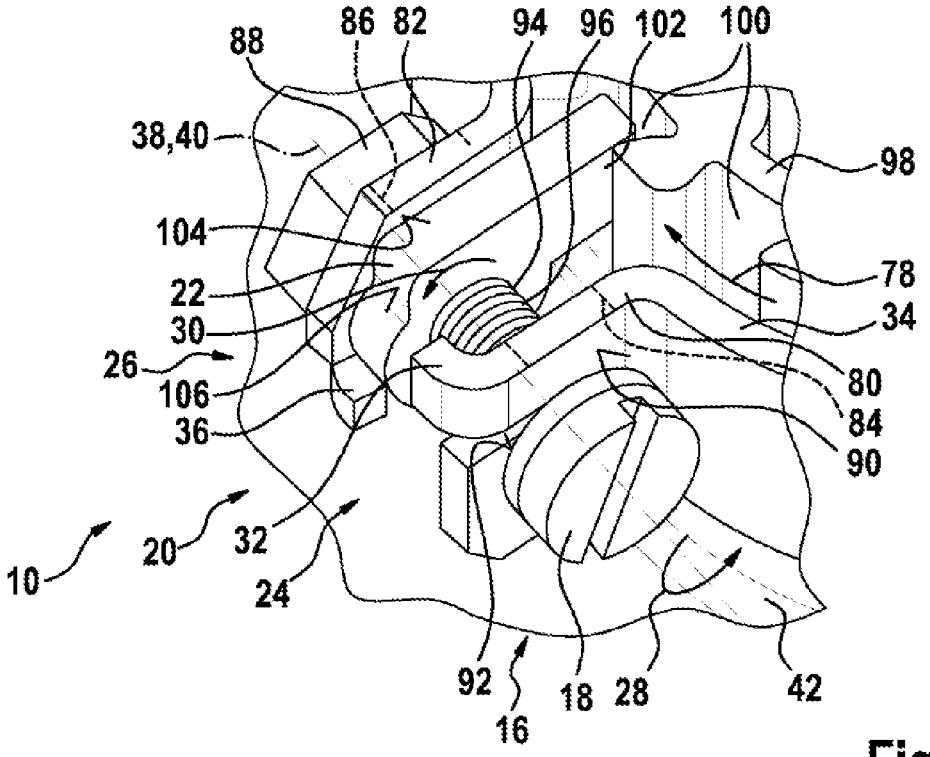
FIG. 4 shows a detail view of the rotation prevention element in a rotation prevention position secured by means of a securing unit of the protective hood rotation prevention device, in a schematic representation.

For the purpose of fastening the protective hood unit 14 to the power tool 12, the protective hood collar 76 is pushed over the clamping collar 98 of the tool receiver 42. Then, by tightening of the clamping element 18 realized as a clamping screw, and by means of the combined action with the clamping element 34 realized as a clamping band, the protective hood collar 76, and thus the protective hood unit 14, becomes clamped to the clamping collar 98 of the tool receiver 42, in a manner already known to persons skilled in the art. During the clamping operation, the rotation prevention element 22 arranged spatially between the clamping element end 80 and the clamping element end 82 of the further clamping element 34 is pivoted about the pivot axis 38, out from the decoupling position of the rotation prevention element 22, in the direction of the clamping collar 98 of the tool receiver 42. As a result of this, the rotation prevention element 22, as a result of a concomitant rotary drive due to a friction of the internal thread 94 of the rotation prevention element 22 and of the external thread 96 of the clamping element 18, is pivoted by a rotary movement of the clamping element 18 contrary to the loosening direction 28 relative to the further clamping element 34, in the direction of the clamping collar 98 of the tool receiver 42 (FIG. 3). In this case, a rotation prevention region 102 of the rotation prevention element 22 is pivoted into a rotation prevention recesses 100 of the clamping collar 98 of the tool receiver 42 (FIG. 4). The clamping collar 98 has a multiplicity of rotation prevention recesses 100 arranged, spaced apart relative to each other, along the circumferential direction 78.

After the rotation prevention region 102 of the rotation prevention element 22 has been pivoted into one of the rotation prevention recesses 100, a further tightening of the clamping element 18 realized as a clamping screw causes the clamping element end 80 and the further clamping element end 82 to be moved toward each other, along the longitudinal axis 40 of the clamping element 18. In this case, the securing element 32 is moved in the direction of the rotation prevention element 22, until an an overlap of the rotation prevention element 22 and the securing element 32 is achieved, as viewed along a direction running at least substantially perpendicularly in relation to the rotation axis of the output shaft 60. As a result of this, the rotation prevention element 22 becomes secured in the rotation prevention position of the rotation prevention element 22, which, in the case of a movement of the clamping element 18 in a loosening direction 28 of the clamping element 18, secures the rotation prevention element 22, at least to a very large extent, against a movement along a decoupling direction 30 of the rotation prevention element 22, out of rotation prevention position of the rotation prevention element 22, in at least one operating state (FIG. 5).

The invention claimed is:

1. A protective hood rotation prevention device of a power tool, comprising:

at least one clamping unit configured to clamp a protective hood unit, the at least one clamping unit including at least one clamping element having at least one rotation prevention unit, the at least one rotation prevention unit having at least one rotation prevention element;

at least one movement coupling unit configured to move the at least one rotation prevention element, in dependence on a movement of the at least one clamping element, in at least one operating state; and at least one securing unit configured, in the case of a movement of the at least one clamping element in a loosening direction of the at least one clamping element, to secure the at least one rotation prevention element to inhibit movement along a decoupling direction of the at least one rotation prevention element, out of a rotation prevention position of the at least one rotation prevention element, in at least one operating state, wherein the at least one rotation prevention element has at least one pivot axis that is at least substantially parallel relative to a longitudinal axis of the at least one clamping element.

2. The protective hood rotation prevention device as claimed in claim 1, wherein the at least one securing unit has at least one securing element arranged on a further clamping element of the at least one clamping unit that acts in combination with the at least one clamping element.

3. The protective hood rotation prevention device as claimed in claim 2, wherein the at least one securing element is configured so as to be integral with the further clamping element.

4. The protective hood rotation prevention device as claimed in claim 1, wherein the at least one securing unit has at least one decoupling element configured to decouple a movement of the at least one rotation prevention element, when the at least one rotation prevention element is in a decoupling position, at least along the decoupling direction of the at least one rotation prevention element, from a movement of the at least one clamping element along the loosening direction of the at least one clamping element, in at least one operating state.

5. The protective hood rotation prevention device as claimed in claim 4, wherein the at least one decoupling element is arranged on a further clamping element of the at least one clamping unit that acts in combination with the at least one clamping element.

6. The protective hood rotation prevention device as claimed in claim 1, wherein the at least one rotation prevention element has at least one stop surface that acts in combination at least with a securing element of the at least one securing unit, in at least one operating state.

7. The protective hood rotation prevention device as claimed in claim 1, wherein the at least one rotation prevention element is coupled to the at least one clamping element by one or more of form closure and force closure.

8. The protective hood rotation prevention device as claimed in claim 1, wherein the at least one rotation prevention element is mounted so as to be movable relative to a further clamping element, in at least one operating state.

9. A power tool system, comprising:

at least one power tool having at least one protective hood unit; and a protective hood rotation prevention device including:

at least one clamping unit configured to clamp the at least one protective hood unit, the at least one clamping unit including at least one clamping element having at least one rotation prevention unit, the at least one rotation prevention unit having at least one rotation prevention element;

at least one movement coupling unit configured to move the at least one rotation prevention element, in dependence on a movement of the at least one clamping element, in at least one operating state; and at least one securing unit configured, in the case of a movement of the at least one clamping element in a loosening direction of the at least one clamping element, to secure the at least one rotation prevention element to inhibit movement along a decoupling direction of the at least one rotation prevention element, out of a rotation prevention position of the at least one rotation prevention element, in at least one operating state, wherein the at least one rotation prevention element has at least one pivot axis that is at least substantially parallel relative to a longitudinal axis of the at least one clamping element.

10. The protective hood rotation prevention device as claimed in claim 1, wherein the power tool is configured as an angle grinder.

11. The power tool system as claimed in claim 9, wherein the at least one power tool is configured as an angle grinder.

12. A protective hood rotation prevention device of a power tool, comprising:

a clamping unit configured to clamp a protective hood unit, the clamping unit including a clamping element having a rotation prevention element;

a movement coupling unit configured to move the rotation prevention element, in dependence on a movement of the clamping element; and a securing unit configured to secure the rotation prevention element during a movement of the clamping element in a loosening direction of the clamping element, wherein securing the rotation prevention element inhibits movement of the rotation prevention element out of a rotation prevention position, and wherein the rotation prevention element is movable about a longitudinal axis of the at least one clamping element.

13. The protective hood rotation prevention device as claimed in claim 12, wherein the securing unit has a securing element arranged on a further clamping element of the clamping unit that acts in combination with the clamping element.

14. The protective hood rotation prevention device as claimed in claim 13, wherein the securing element is integral with the further clamping element.

15. The protective hood rotation prevention device as claimed in claim 12, wherein the securing unit has a decoupling element configured to decouple a movement of the rotation prevention element, when the rotation prevention element is in a decoupling position, at least along the decoupling direction of the rotation prevention element, from a movement of the clamping element along the loosening direction of the clamping element, in at least one operating state.

16. The protective hood rotation prevention device as claimed in claim 15, wherein the decoupling element is arranged on a further clamping element of the clamping unit that acts in combination with the clamping element.

17. The protective hood rotation prevention device as claimed in claim 12, wherein the rotation prevention element has at least one stop surface that acts in combination with a securing element of the securing unit, in at least one operating state.

18. The protective hood rotation prevention device as claimed in claim 12, wherein the rotation prevention element is coupled to the clamping element by at least one of a form closure and a force closure.

19. The protective hood rotation prevention device as claimed in claim 12, wherein the rotation prevention element is mounted so as to be movable relative to a further clamping element, in at least one operating state.

* * * * *